United States Patent [19]

Hed et al.

[11] Patent Number: 4,611,661

[45] Date of Patent: Sep. 16, 1986

[54] RETRIEVABLE EXPLORATION GUIDE BASE/COMPLETION GUIDE BASE SYSTEM

[75] Inventors: Jon E. Hed; Robert B. Draper, both of Ventura, Calif.

[73] Assignee: Vetco Offshore Industries, Inc., Ventura, Calif.

[21] Appl. No.: 723,023

[22] Filed: Apr. 15, 1985

[51] Int. Cl.[4] ..... E21B 33/035; E21B 43/01

[52] U.S. Cl. ..... 166/339; 166/340; 166/342; 166/349; 166/365; 166/378; 166/368; 405/168

[58] Field of Search ..... 166/338, 339, 340, 341, 166/342, 349, 351, 360, 365, 368, 377, 378; 175/7; 405/168

[56] References Cited

U.S. PATENT DOCUMENTS

| | | | |
|---|---|---|---|
| 3,163,228 | 12/1964 | Hayes | 166/340 X |
| 3,321,015 | 5/1967 | Word, Jr. | 166/340 |
| 3,779,313 | 12/1973 | Regan | 166/360 |
| 3,967,460 | 7/1976 | Cassity | 166/349 X |
| 4,286,665 | 9/1981 | Walker | 166/342 X |
| 4,387,771 | 6/1983 | Jones | 166/349 X |
| 4,405,263 | 9/1983 | Hall | 166/342 X |
| 4,541,755 | 9/1985 | Castel et al. | 166/341 X |

FOREIGN PATENT DOCUMENTS

| | | | |
|---|---|---|---|
| 2181270 | 5/1972 | Australia | 166/342 |

*Primary Examiner*—Stephen J. Novosad
*Assistant Examiner*—John F. Letchford
*Attorney, Agent, or Firm*—Joseph R. Dwyer

[57] ABSTRACT

A system for connecting an exploratory well into a producing well by retrieving a permanent guide base (P) and replacing the same with a completion guide base (C) containing the necessary equipment for producing from the well. To do this, the permanent guide base comprises two parts; a gimbal part (32) and a platform part (34)—the platform part (34) can be detached from the low pressure wellhead housing (W) and retrieved leaving the wellhead housing (W) and the permanent guide base gimbal part (32) subsea. The wellhead housing (W), provided with a latching profile (154), though not used during exploratory drilling, is now used to latch the completion guide base (C) thereto for production from the well. The two parts of the retrievable permanent guide base are latched together by a latching mechanism (74) which is easily releasable to unlatch one part from the other, and both guide bases (P & C) are provided with wire line guide posts (82) which are easily detachable for replacement if necessary.

7 Claims, 9 Drawing Figures

RETRIEVABLE EXPLORATION GUIDE BASE/COMPLETION GUIDE BASE SYSTEM

BACKGROUND OF THE INVENTION

This invention relates to subsea wells and is specifically directed to a system whereby an exploratory well can be made into a production well through the use of a retrievable permanent guide base and a conventional latching profile near the upper end of a wellhead housing.

The conventional method of drilling a subsea well utilizes a temporary guide base which is lowered to the sea bed and through which a hole is drilled. The guide wires provide guidance for the drill string and drilling assembly, and guidance for subsequent tools and equipment. Typically the hole is 36" in diameter to accommodate a 30" wellhead housing and a string of 30" casing connected thereto. This 30" wellhead housing is sometimes referred to as the low pressure wellhead housing. Once this hole is drilled to the desired depth, a permanent guide base, together with the 30" wellhead housing clamped thereto, and the desired length of 30" casing, is lowered through the water and the permanent guide base is landed on the temporary guide base.

The permanent guide base is conventionally provided with a gimbal which engages a conically shaped landing ring in the temporary guide base as a means for aligning the permanent guide base horizontally.

The permanent guide base is also provided with vertical posts to provide guidance for subsequent tools and equipment and cooperates with guidelines on the temporary guide base.

After the permanent guide base is positioned on the temporary guide base, the 30" housing is then cemented in place.

The U.S. Pat. No. 4,387,771 of Darrell Jones entitled "Wellhead System for Exploratory Wells" discloses one system of converting an exploratory well to a production well through the use of a separate profile ring which is supported from the wellhead housing and, in turn, supports the wellhead, often termed the high pressure wellhead. This high pressure wellhead typically has an internal diameter of 16 ¾ or 18¾, inches. Subsequent production apparatus, such as the production tree or a conductor riser, may be connected to this profile ring. The profile ring for a nominal initial investment extended the capabilities of the existing system for converting an exploratory well into a production well.

Whether the system of the Jones patent is used, or whether the systems existing prior to the Jones patented system are used to convert the exploratory well into a producing well, the permanent guide base remained subsea and had to be dealt with.

It is an object of this invention to provide a system by which an exploratory well can be converted to a producing well by retrieving the permanent guide base and replacing the same with a completion guide base containing the necessary equipment for producing from the well.

It is apparent that the system of this invention allows the retrieved permanent guide base to be used again and again resulting in considerable cost savings.

SUMMARY OF THE INVENTION

This invention, which meets the foregoing objects, is a system in which the permanent guide base comprises two parts—a platform part that can be detached from the low pressure wellhead housing and retrieved leaving the wellhead housing and a gimbal part subsea. The wellhead housing, provided with a latching profile, though not used during exploratory drilling, is now used to latch the completion guide base thereto for production from the well. The two parts of the retrievable permanent guide base are latched together by a latching mechanism which is easily actuated to unlatch one part from the other, and both guide bases are provided with wire line guide posts which are easily detachable for replacement if necessary.

DETAILED DESCRIPTION

Figure 1:
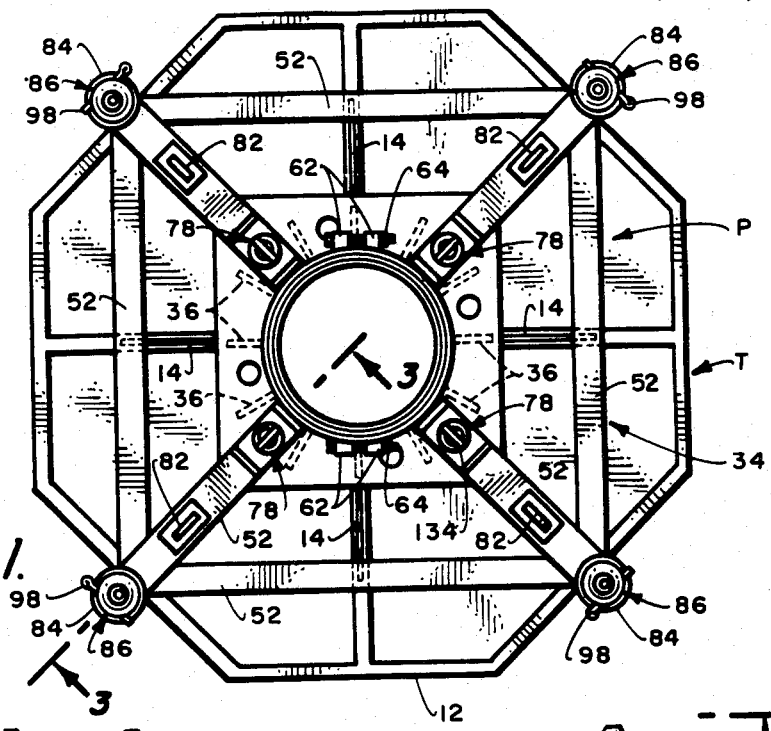
FIG. 1 is a top plan view of the retrievable permanent guide base of this invention.
Figure 2:
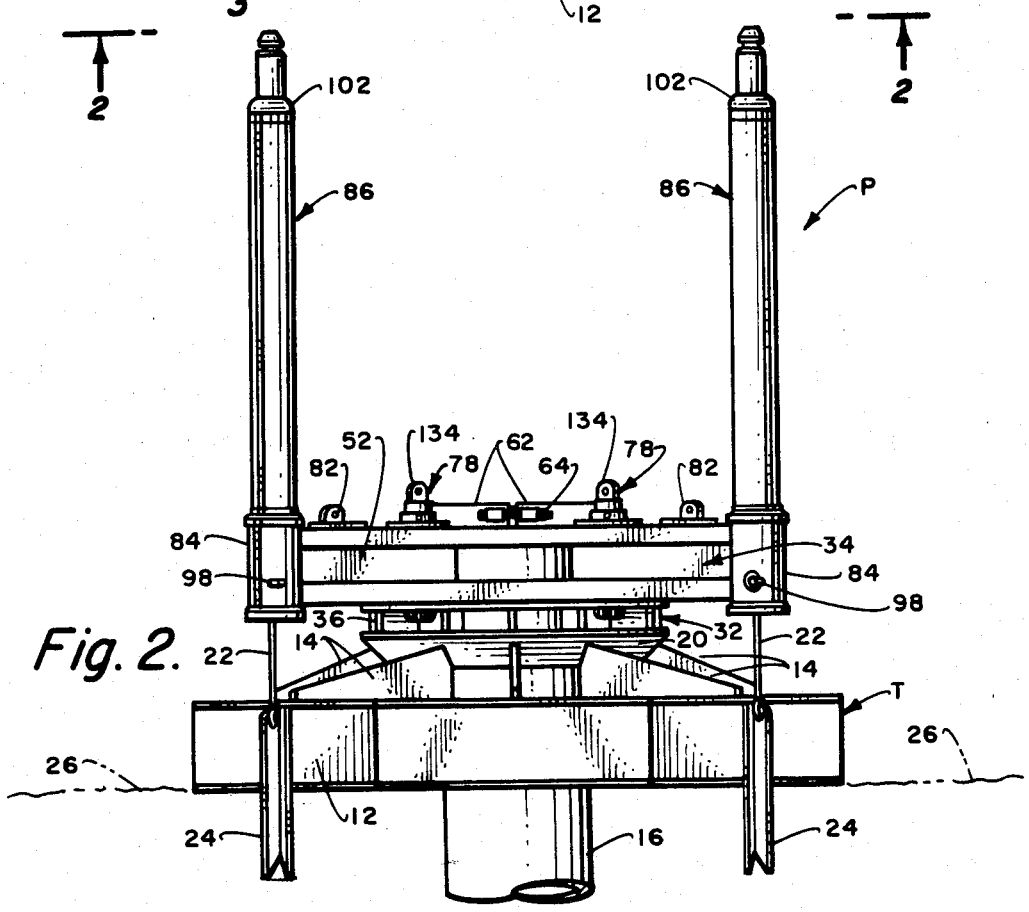
FIG. 2 is an elevational view of the retrievable permanent guide base of the invention taken along line 2—2 of FIG. 1 and shown landed on a temporary guide base at the mud line.

To facilitate the description and understanding of this invention, each of the main pieces of equipment, identified generally as a temporary guide base T, a retrievable permanent guide base P, a wellhead housing W, and a completion guide base C, will be described separately.

Temporary Guide Base—T (FIGS. 1, 2, 3, 5, 7 and 8)

The temporary guide base T, sometimes called a mud mat, is a relatively flat, conventionally octagonal device fabricated from I-beams or hollow rectangular box beams 12, radially oriented gusset plates 14 and provided with a large centrally located sleeve 16 and with an upwardly facing cone 20 from which the beams and gussets radiate. Guide lines 22 (two shown in FIG. 2) are connected to form the means by which later equipment is guided and four ground base legs 24 protrude downwardly below the mud line 26 (ocean floor). In practice, the temporary guide base T and guide lines 22 are lowered to the mud line 26 by a vessel or stationary platform located on the surface of the water by a running tool located on the end of a drill string. Suitable connecting means, such as J-slots (not shown), are formed on the inner sleeve to connect the running tool to the guide base. This running tool is disconnected when the temporary guide base is positioned on the ocean floor.

This temporary guide base is the first piece of equipment that is used in preparation for drilling of an exploration well.

The next step is to lower a drilling assembly (not shown) guided by the guide wires by a suitable guide frame (also not shown) which is run through the sleeve 16 to drill into the ocean bottom. The drilled hole is larger than the first casing to be placed within the well and, conventionally, this bore is 36" to accommodate a 30" wellhead housing W and casing.

Retrievable Permanent Exploration Guide Base—P

(FIGS. 1-6)

This guide base P, unlike conventional permanent guide bases, is formed of two parts 32 and 34, a gimbal 32 and a platform 34 (more clearly shown in FIG. 5), suitably latched together. (When it is mentioned herein that the retrievable permanent guide base P is removed or retrieved, what is meant is that the platform part 34 is retrieved. The gimbal part 32 remains and is used with the completion guide base C to be described.) The gimbal part 32 comprises conventionally a plurality of plates 36 attached to a horizontal gimbal plate 40 and to a central gimbal sleeve 42. The outer periphery of the plates 36 are curved and emanate radially from the gimbal sleeve 42 and are attached, as by welding, to the gimbal sleeve 42 and gimbal plate 40. The inner bore of the gimbal sleeve is conically chamfered at the top, as at 44, to provide a loading surface for a downwardly facing shoulder 46 formed in the wellhead housing W. The wellhead housing W will be described in detail later. This gimbal 36 interfaces with the cone 20 on the temporary guide base T when landed and, is conventional, except for the fact that it is detachable from the remainder of the temporary guide base.

The second part 34 of the temporary guide base P is essentially a flat, rectangular platform fabricated from hollow box beams 52. Centrally of the beams is a sleeve 54 coaxial with the gimbal sleeve 42, but of a larger diameter than the gimbal sleeve to accommodate the landing surface 44. When viewed from the top, FIG. 1, the beams 52 radiate from the sleeve 54 as diagonals of the rectangle formed by the remaining beams 52. Near the top of the outer surface of the sleeve 54 (as shown more clearly in FIG. 5), a groove 56 is formed to receive a radially inwardly extending rim 60 of a circular clamping ring 62. This clamping ring 62 is split and provided with a flange/bolt assembly 64 (FIG. 1) to allow the ring to be inserted over, and be tightened around, the sleeve 54. This clamping ring 62 also encloses a split positioning ring 66 within a radially opening groove 70 in the clamping ring which engages the top end 72 of the wellhead housing W and together with the landing surface 44 on the sleeve and shoulder 46 on the wellhead housing hold the wellhead housing clamped within the sleeve 54.

Also, the top of sleeve 42 of the gimbal extends upwardly above the gimbal plate 40 and the junction of the sleeve and gimbal plate is recessed at 74 to receive the bottom of the sleeve 54 of the platform.

Spaced from the sleeve 54 a slight distance, but within the area defined by the gimbal plate 40, are a plurality of bores 76 (four shown) which contain latching means 78 to connect the platform part 34 to the gimbal 32 by extending through the bores 76 in the box beams and into suitable holes 80 in the gimbal plate 40.

Also spaced beyond the latching means 78 are eyelets 82 attached to the diagonal beams 52 to aid in lifting the platform part 34 at the appropriate time.

At each corner, the guide base is provided with sleeves which act as sockets 84 for guide posts 86 conventionally used with the guide lines 22.

Guide Posts

(FIGS. 1-4, 7 and 8)

The guide posts 86 are elongated tubular members, each comprising three parts welded together. The first part, lower end or stab 88, is insertable into the socket 84 of the permanent guide base P. The stab 88 is conically formed to aid in guiding the guide post 86 into the socket 84 and is also provided with a rim 90 which forms a stop against a rim 92 on the socket 84 to limit the lower travel of the guide post in the socket. Suitable orienting means is also provided in the form of an enlargement 94 on the rim 90 of the stab which seats in a suitable notch 96 in the rim 92 of the socket. The stab and socket are suitably cross-bored so that a cotter pin 98 may be inserted therethrough and through the socket to lock the guide post 86 in the socket and guide base.

The stab is welded to an elongated tube 100 (the second part) which, in turn, is provided with a conically formed post top 102 (the third part). All three parts, as well as the sockets, are slit through their length (the slits 104, 106 and 108 in the stab, tubular member 100 and socket being shown in FIGS. 3 and 4) to receive one of the guide lines 22 which will extend the length of the guide posts and beyond. In practice, the guide lines 22 are strung through these posts vertically and are used to guide the permanent guide base P to the ocean floor. A feature of these guide posts, however, is that they are removably connected to the sockets. Thus, in the event that any guide post is broken or bent, it can be easily replaceable by simply inserting a new guide post in the socket and latching the same with a cotter pin.

Latching Means

Figures 3, 4:
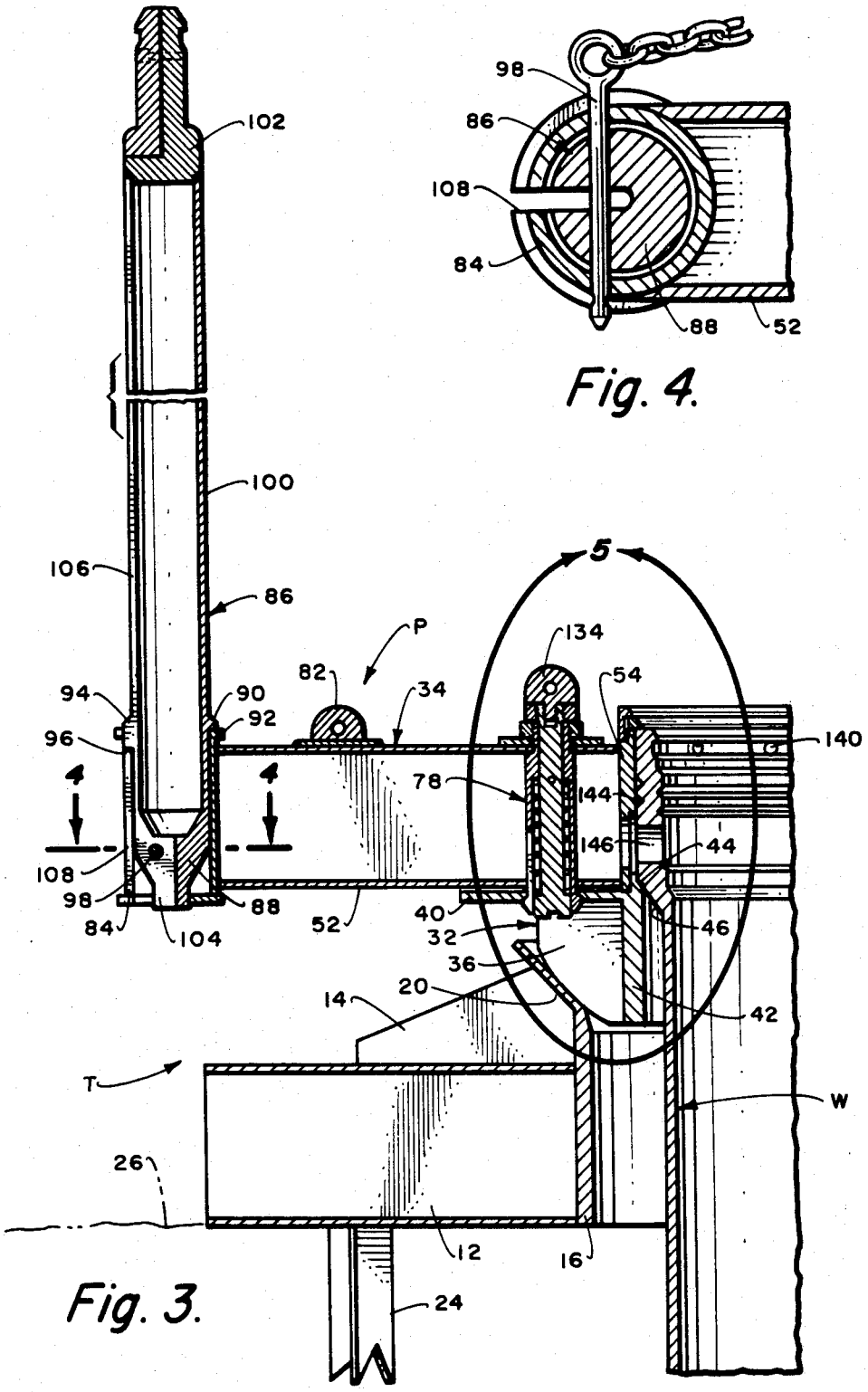
FIG. 3 is an enlargement of a portion of FIG. 1, taken along line 3—3 of FIG. 1, to show certain details of the invention.
FIG. 4 is a cross-sectional view, taken along line 4—4 of FIG. 3, and enlarged to show the details of the socket and stab of the guide posts.
Figure 5:
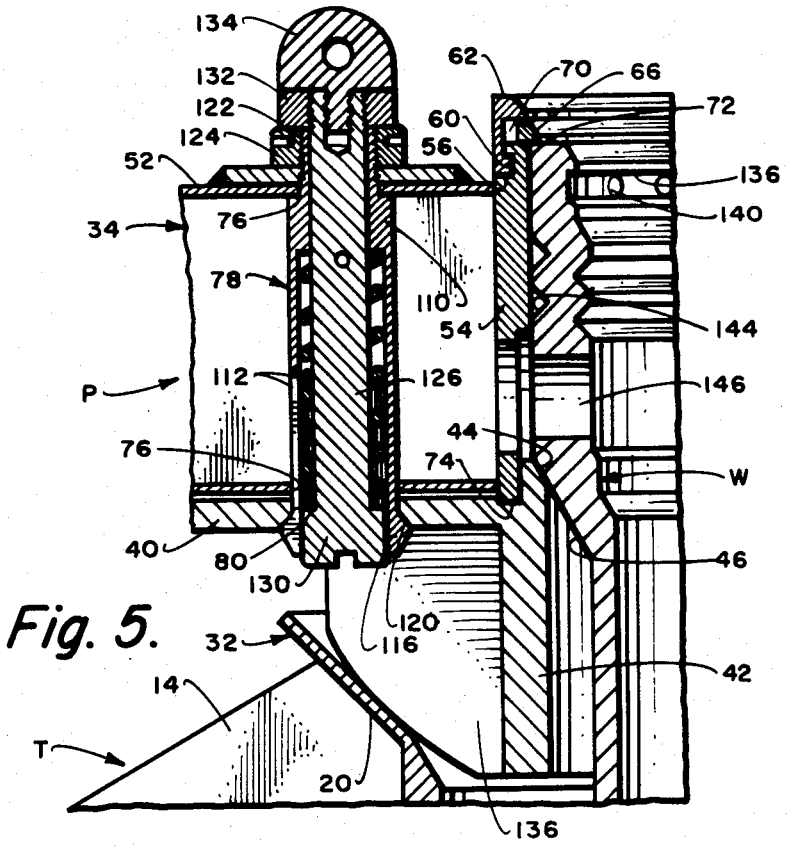
FIG. 5 is an enlargement of the area encircled by arrow 5—5 of FIG. 3 to show that area in more detail.
Figure 6:
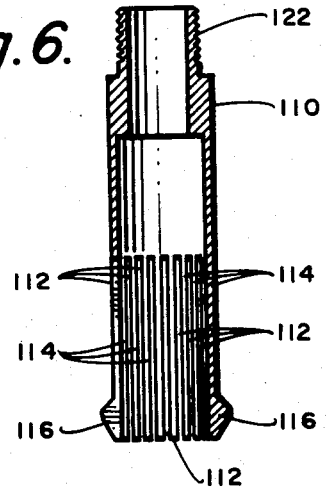
FIG. 6 is an elevational, cross-sectional view of part of the latching means, as shown in FIG. 5, to illustrate certain details thereof.

(FIGS. 3, 5 and 6)

Each of the latching means 78 for connecting the two parts 32 and 34 of the retrievable permanent guide base P together comprises an outer cylinder 110 of a length to span the thickness of the two parts and beyond to latch the two parts together. The cylinder 110 is formed with vertical elongated slots 112 which essentially form fingers 114 with thickened finger tips 116 at their lower ends which can extend through the bores 76 beyond the gimbal plate 40. The finger tips 116 engage the chamfered edges 120 on the openings 80 when in latched position. The upper end of the outer cylinder 110 is reduced and threaded as at 122 so as to be inserted through bore 76 in an upper wall of the box beam 52 and fastened to the platform part 34 by threading a nut 124 thereon.

Within the cylinder 110 is a reciprocable spring biased latching cylindrical mechanism or plug 126 having a lower end 130 of the same diameter as the bore of the outer cylinder 110 and which, when inserted, expands the fingers 116 so that they engage the bottom of the gimbal plate 40 and lock the two parts 32 and 34 together. The upper end of the plug is also threaded as at 132 and provided with an eyelet 134 by which a hook on a line extending from the surface can pull or jerk the plug 126 and thus release the fingers 116 allowing separation of the two parts of the temporary guide base.

Wellhead Housing—W (FIGS. 3, 5, 8 and 9)

The wellhead housing W, sometimes referred to as a 30" or low pressure wellhead housing, is essentially the first piece of equipment forming the well bore and comprises a wellhead housing and extension (not shown) to which is connected a plurality of 30" casing (not shown). The number of casing attached to the wellhead housing and extension depends on the depth of the initial bore. The wellhead housing W is provided with suitable landing surfaces both within the bore and on the outer periphery. The outer surface of the wellhead housing W is provided with the downward shoulder 46 which engages the landing surface on the landing surface 44 of the gimbal sleeve 42, as previously mentioned.

Near the top end of the inner bore, the wellhead housing is provided inner grooves 136 and circumferentially spaced openings 140 spaced throughout the circumference of the wellhead. Either the inner grooves 136 or the openings 140 are engaged by a suitable running tool to lower the wellhead housing W, casing and retrievable permanent guide base P to the temporary guide base T on the ocean floor. Selected inner grooves 136 are also used to support a high pressure wellhead 142 (FIG. 8), as will be described in connection with the completion guide base C, infra. The outer periphery of the wellhead housing W is provided with latching grooves 144 of the conventional type, but which are not used by or during the time that the permanent guide base P is being used. Finally, the wellhead housing W and the sleeve 54 of the permanent guide base are provided with circulation ports 146 circumferentially spaced and aligned together when the permanent guide base P and wellhead housing W are assembled on the platform.

As mentioned previously, the wellhead housing W is latched to the permanent guide base by the split positioning ring 66 engaging the top 72 of the wellhead housing and cooperating with the shoulder and landing surface 44 and 46.

From the foregoing is can be seen that the wellhead housing W with its casing attached thereto is latched within the permanent guide base P and the entire assembly is lowered from the rig, guided towards the temporary guide base T by means of the guide wires 22. Once landed, the wellhead housing W is cemented into the bore in the conventional manner and drilling operations take place within this low pressure wellhead housing in the conventional manner.

As mentioned above, a unique feature of this invention is the fact that the permanent guide base is retrievable so that a completion guide base can be lowered and latched to the wellhead. Thus, to remove the permanent guide base, suitable lines are lowered and connected to the eyelets 82 on the guide base and to the eyelets 134 on the latching means 78. At the appropriate time, the eyelets 134 on the latching means are pulled or jerked against the bias of the spring and the fingers are released so that the platform of the permanent guide base 34 is released from the gimbal 32 and the platform 34 is retrieved. Note that since the wellhead housing has landed on the sleeve of the gimbal and the top latch on the upper portion of the guide base is resting only on the top of the wellhead, the guide base and its inner sleeve is free to move vertically off the wellhead.

Figure 7:
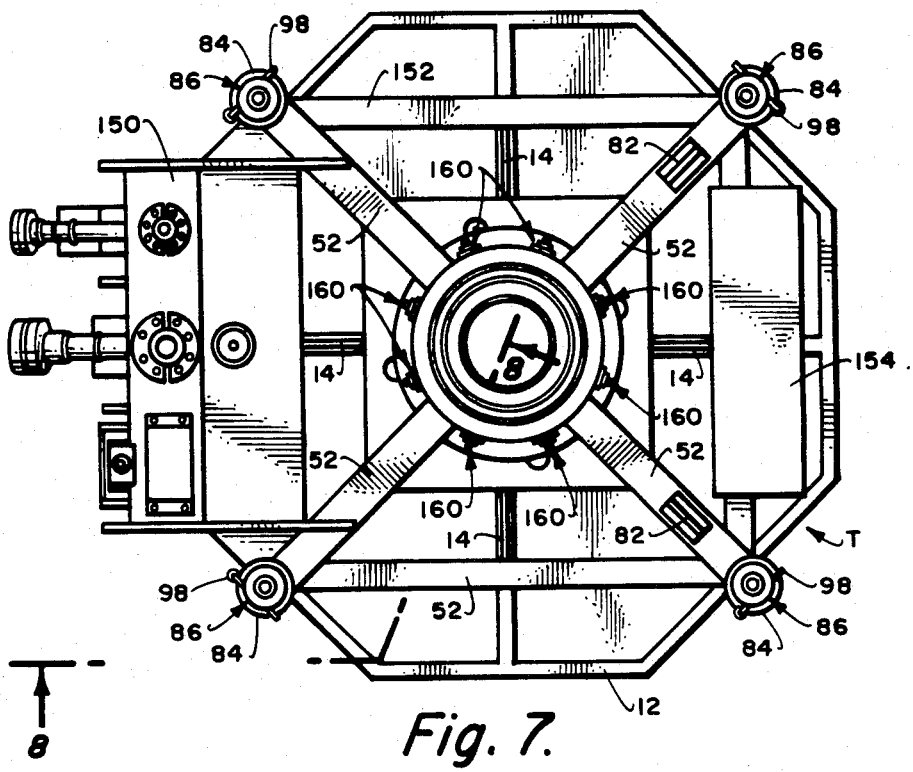
FIG. 7 is a top plan view of the completion guide base, landed on the temporary guide base, after the retrievable permanent guide base has been removed.
Figure 9:
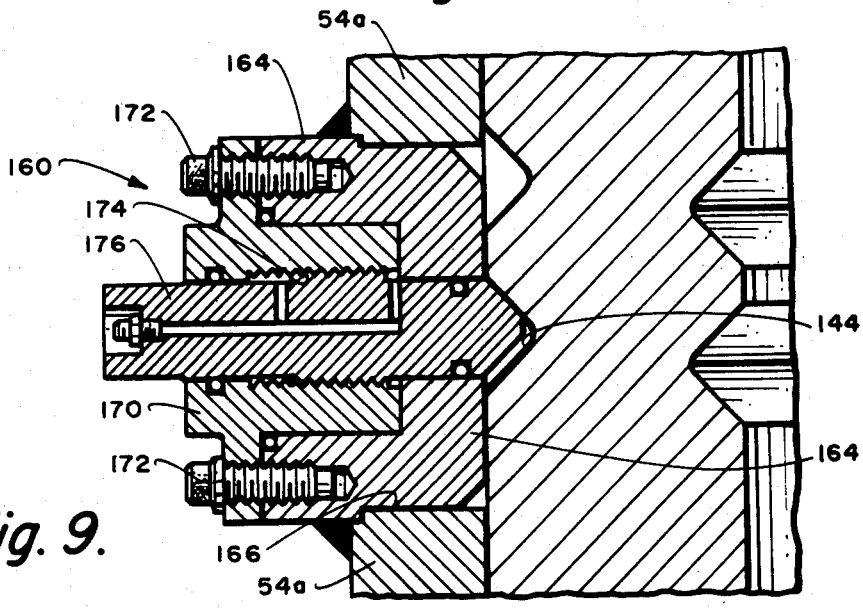
FIG. 9 is an enlargement of the area encircled by the arrow 9 in FIG. 8 to illustrate the lockdown dogs in more detail.
Figure 8:
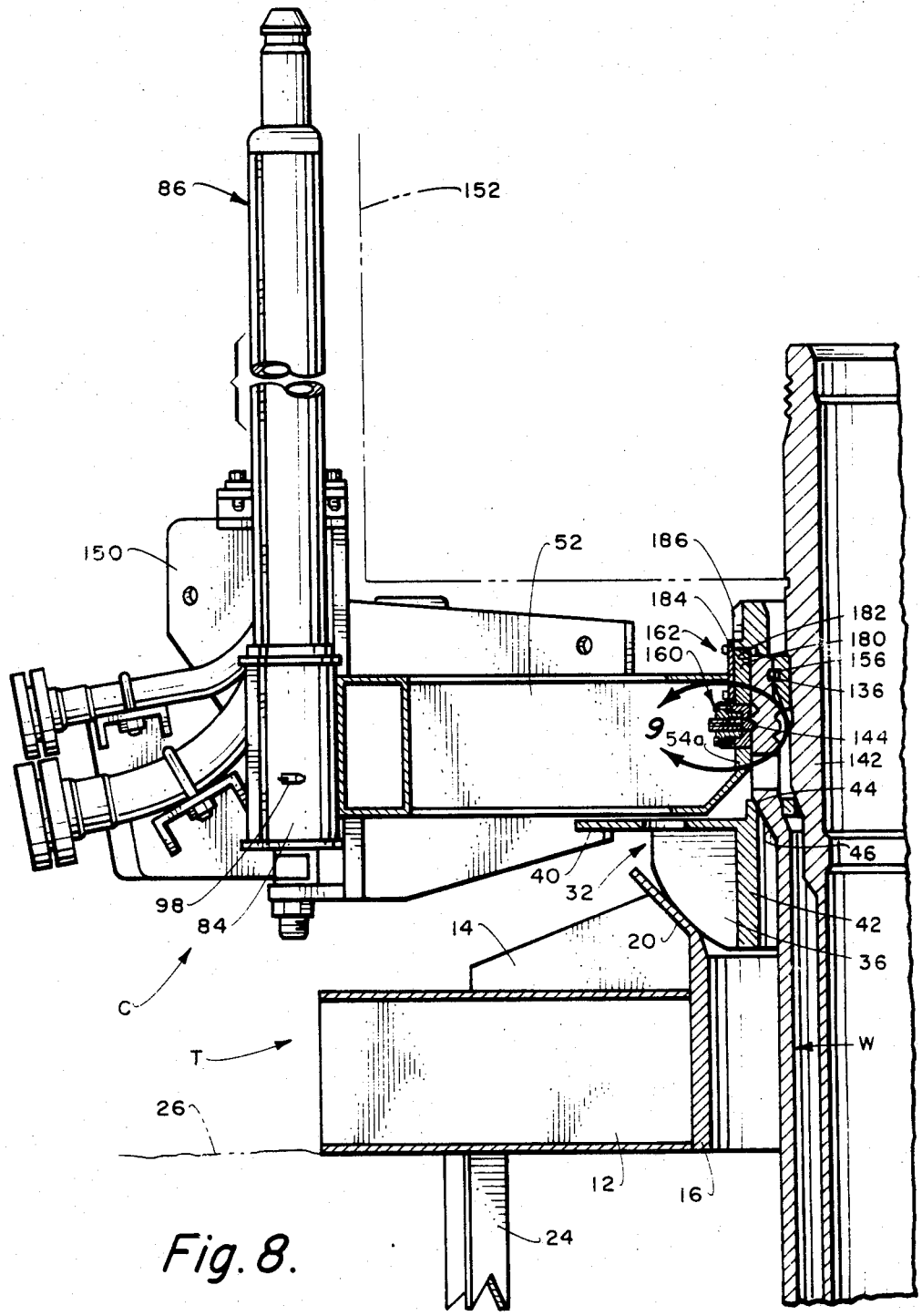
FIG. 8 is a partial elevational view, taken along line 8—8 of FIG. 7, showing a completion guide base on the temporary guide base at the mud line.

Completion Guide Base—C (FIGS. 7–9)

In describing the completion guide base C, for simplicity where identical components are used, they are given the same reference number as used in the prior figures, and where such components are used but modified for a particular purpose, the suffix "a" is added. Thus, the completion guide base C, like the retrievable permanent guide base, is similarly formed as a flat platform of suitable hollow cylindrical box beams 52 and provided with a centrally located sleeve **54*a* and guide posts 86 (four shown) of the same type as used in the retrievable permanent guide base and similarly positioned in sockets 84. In plan view, the completion guide base C is similar in that it is rectangular with diagonal box beams 52 emanating from the centrally located sleeve 54*a***.

Shown, however, is the gimbal part 32 of the retrievable permanent guide base P supported on the low pressure wellhead W and the bottom of the completion guide base is resting on the gimbal plate 40 which, in turn, is supported by the temporary guide base T.

The completion guide base C contains a suitable flowline assembly 150 for connection to the completion tree and to flowlines extending to the vessel or to shore for storing and processing the well products. Shown in phantom is the blowout prevention stack clearance envelope 152 and counterweights 154 to illustrate where the latter would be located with respect to the completion guide base C.

All the necessary equipment for a completion guide base such as C are conventional and need not be further described.

Within the low pressure wellhead housing W is the high pressure wellhead housing 142, as previously mentioned, which is shown latched on a selected groove 136 by a locking ring 156.

The sleeve **54*a* of this guide base C is, however, provided with a plurality of locking dog assemblies 160 for engaging the latching profile (grooves) on the low pressure housing and orientation key assemblies 162 for selectively orienting the flowline assembly 150** relative to the flowlines on the subsea floor.

It is noted that the latching profile 144 is now being used and forms an important part of this invention since without such latching profile, the ability to land the completion guide base C on the wellhead would be seriously curtailed.

The locking dog assemblies 160 each comprise a hollow cylindrical housing 164, U-shaped in cross-section, attached, as by welding, on an opening 166 in the sleeve **54*a*. The housing 164 contains an insert 170 attached to the housing by bolts 172. The insert is centrally bored and threaded, as at 174, to receive a locking dog 176. The locking dog 176 is provided with external threads which engage internal threads 174 and are moved into engagement with the latching profile 144** by rotation.

The locking dog assemblies 160 are shown as an example since other such assemblies may be used. See the locking dog assemblies in U.S. Pat. Nos. 4,074,912 and 3,827,728.

The orientation key assemblies 162 each comprise a key 180 inserted in selected notches 182 in the sleeve **54*a* and covered by a plate 184. A number of notches 182 are formed in the sleeve 54***a* to provide a number of possible positions for the guide base C, but only two keys 180 located 180° apart are needed.

Finally, to lower the completion guide base, the sleeve 54*a* is provided with J-slots 186 (one shown) for connection to a running tool (also not shown) in the conventional manner.

We claim:

1. A system for converting a subsea exploratory well into a production well, said well including a temporary guide base located subsea with guide lines extending to the water surface and a central opening through which drilling operations are conducted;

a retrievable permanent guide base adapted to be lowered onto said temporary guide base and guided thereto by said guide lines;

said permanent guide base comprising two parts, one part including gimbal means adapted to engage said temporary guide base, and a second part including platform means, means for releasably latching said platform to said gimbal means, and a centrally located sleeve for carrying and directing a wellhead housing through said opening in said temporary guide base;

said platform means being separated and retrieved to the water surface leaving said gimbal means on said temporary guide base as part of said conversion, and a completion guide base having equipment for producing from the well which, when lowered to the well, lands on the gimbal means.

2. The system as claimed in claim 1 wherein said wellhead housing has external latching profile means and wherein said completion guide base includes means for engaging said latching profile to latch said completion guide base to said wellhead housing.

3. The system as claimed in claim 2 wherein said completion guide base is guided to said temporary guide base by said guide lines.

4. The system as claimed in claim 3 wherein both said permanent guide base and said completion guide base include guide posts individually and releasably attached to said guide bases, said guide posts cooperating with said guide wires to guide said guide bases to said temporary guide base.

5. The system as claimed in claim 4 wherein said temporary guide base includes a cone surrounding said opening and having its larger end facing towards the water surface and wherein said gimbal means defines a curved envelope cooperable with said cone and a gimbal plate on the side opposite said curved envelope and engageable by said platform means and by said completion guide base.

6. The system as claimed in claim 5 wherein said means for releasably latching said platform to said gimbal means includes a latching mechanism extending through said platform and through said gimbal plate.

7. A method of converting a subsea exploratory well into a production well comprising the steps of;

locating a temporary guide base on a subsea mud line, providing a permanent guide base in two parts latched together, providing a wellhead housing with an external latching profile and assembling said two parts of said permanent guide base and said wellhead housing together and lowering the assembly onto said temporary guide base, releasing part of said permanent guide base leaving the second part of said permanent guide base and said wellhead housing subsea, providing a completion guide base with equipment for producing from the well and lowering said completion guide base onto said temporary guide base.

* * * * *